US011139597B2

(12) United States Patent
Hsiao et al.

(10) Patent No.: US 11,139,597 B2
(45) Date of Patent: Oct. 5, 2021

(54) CONNECTOR ASSEMBLY

(71) Applicant: BizLink International Corp., New Taipei (TW)

(72) Inventors: Hsin-Tuan Hsiao, New Taipei (TW); Jui-Hung Chien, New Taipei (TW)

(73) Assignee: BizLink International Corp., New Taipei (TW)

( * ) Notice: Subject to any disclaimer, the term of this patent is extended or adjusted under 35 U.S.C. 154(b) by 59 days.

(21) Appl. No.: 16/679,268

(22) Filed: Nov. 10, 2019

(65) Prior Publication Data

US 2020/0366016 A1 Nov. 19, 2020

(30) Foreign Application Priority Data

May 15, 2019 (TW) ..... 108116789

(51) Int. Cl.

| | |
|---|---|
| ***H01R 4/50*** | (2006.01) |
| ***H01R 12/71*** | (2011.01) |
| ***H01R 12/72*** | (2011.01) |
| ***H01R 13/502*** | (2006.01) |
| ***H01R 13/631*** | (2006.01) |
| ***H01R 13/52*** | (2006.01) |
| ***H01R 13/627*** | (2006.01) |
| ***H01R 13/648*** | (2006.01) |

(52) U.S. Cl.

CPC ..... *H01R 12/716* (2013.01); *H01R 12/724* (2013.01); *H01R 13/502* (2013.01); *H01R 13/52* (2013.01); *H01R 13/627* (2013.01); *H01R 13/631* (2013.01); *H01R 13/648* (2013.01)

(58) Field of Classification Search

CPC .... H01R 12/716; H01R 12/72; H01R 12/722; H01R 12/724; H01R 12/725; H01R 13/502; H01R 13/52; H01R 13/627; H01R 13/631

USPC ..... 439/79, 345

See application file for complete search history.

(56) References Cited

U.S. PATENT DOCUMENTS

| | | | | |
|---|---|---|---|---|
| 2015/0044913 | A1* | 2/2015 | Chen | H01R 13/62 439/676 |
| 2019/0372251 | A1* | 12/2019 | Huang | H01R 12/7023 |
| 2020/0244010 | A1* | 7/2020 | Chua | H01R 13/6581 |

FOREIGN PATENT DOCUMENTS

| | | | |
|---|---|---|---|
| CN | 203536647 | U | 4/2014 |
| CN | 204156225 | U | 2/2015 |
| CN | 204289855 | U | 4/2015 |
| CN | 205985588 | U | 2/2017 |
| CN | 107221812 | A | 9/2017 |
| CN | 206595468 | U | 10/2017 |
| CN | 206712089 | U | 12/2017 |
| CN | 207677189 | U | 7/2018 |
| CN | 109193206 | A | 1/2019 |

(Continued)

*Primary Examiner* — Khiem M Nguyen

(74) *Attorney, Agent, or Firm* — CKC & Partners Co., LLC

(57) ABSTRACT

A connector assembly includes a wire end connector for electrically connecting to a board end connector. The wire end connector includes a main body portion and an insertion portion. The insertion portion is connected to the main body portion, and the insertion portion is configured to couple to the board end connector. The main body portion is provided with a plurality of elastic claws extending outward from the main body portion to press on the board end connector when the insertion portion is coupled to the board end connector so as to stably connect the wire end connector to the board end connector.

16 Claims, 4 Drawing Sheets

(56) References Cited

FOREIGN PATENT DOCUMENTS

| | | | |
|---|---|---|---|
| CN | 109411951 | A | 3/2019 |
| TW | M480803 | U | 6/2014 |
| TW | M565419 | U | 8/2018 |
| TW | M584029 | U | 9/2019 |

* cited by examiner

CONNECTOR ASSEMBLY

RELATED APPLICATIONS

This application claims priority to Taiwan Application Serial Number 108116789, filed May 15, 2019, which is herein incorporated by reference.

TECHNICAL FIELD

The present disclosure generally relates to a connector assembly. More particularly, the present disclosure relates to a wire end connector assembly.

BACKGROUND

With the development and innovation of various high frequency electronic products, new high frequency electronic products require relatively more bandwidth. Therefore, the world today relies on the rapid and reliable information transmission.

In the electronic communication equipment for transferring large volumes of information, the wire-to-board connector is one kind of connector device widely used in electronic communication field, which includes a wire-end connector and a board end connector. Normally, the board-end connector is mounted on a circuit board.

At present, in high-speed transmission devices, Slim Serial Attached Small Computer System Interface (Slim SAS) and Slim SAS Low Profile are widely used in the computer equipment of data centers, especially in the computer equipment such as servers, switches, storage and workstations.

However, when the wire end connector and the board end connector are connected together, although electrical conduction is achieved, the wire end connector and the board end connector still have tolerance and fit problems. Thus, while the conventional wire end connectors and board end connectors are connected together, some of them may be loose. When the loosening problem occurs, signal transmission may be unstable or even causing disconnection, thereby affecting the signal transmission quality and signal transmission efficiency.

SUMMARY

One objective of the embodiments of the present invention is to provide a connector assembly for improving the connection stability of a wire end connector and a board end connector of the connector assembly, thereby improving the transmission rate and transmission quality of the connector assembly.

To achieve these and other advantages and in accordance with the objective of the embodiments of the present invention, as the embodiment broadly describes herein, the embodiments of the present invention provides a connector assembly having a wire end connector for electrically connecting to a board end connector. The wire end connector includes a main body portion and an insertion portion. The insertion portion connects to the main body portion, and the insertion portion is configured to couple to the board end connector. The main body portion includes a plurality of elastic claws extending outwardly from the main body portion to exert pressure upon the board end connector when the insertion portion and the board end connector are coupled together so as to stably connect the board end connector.

The wire end connector further includes a printed circuit board, a cable, and an inner film. The printed circuit board is disposed in the main body portion and the insertion portion, the cable is soldered on the printed circuit board and the inner film covers soldering joints of the cable and the printed circuit board.

In some embodiments, the wire end connector further includes an intermediate casing covering the inner film and exposing a plurality of signal terminals of the printed circuit board, and a spring latch is fixed on the intermediate casing.

In some embodiments, the wire end connector further includes an outer casing covering a portion of the intermediate casing, a portion of the inner film and a portion of the elastic claws.

In some embodiments, the printed circuit board further includes at least one elastic claw ground terminal exposing from the inner film and sealed in the outer casing, wherein the at least one elastic claw ground terminal is electrically connected to at least one of the elastic claws.

In some embodiments, the elastic claws includes a plurality of first elastic claws parallel to a surface of the printed circuit board to press on a metal shell of the board end connector.

In some embodiments, the elastic claws further include a plurality of second elastic claws perpendicular to the surface of the printed circuit board so as to clamp two sides of the metal shell of the board end connector.

In some embodiments, at least one of the first elastic claws further includes a pressure bump parallel to a plug and unplug direction of the wire end connector and the board end connector, and at least one of the second elastic claws includes a pressurized curved surface protruding from a surface of the corresponding second elastic claw about 0.01 mm to 1 mm.

In some embodiments, at least one of the first elastic claws further includes a first supporting portion, at least one of the second elastic claws includes a second supporting portion, a connecting portion is connected to the first supporting portion and the second supporting portion, and the connecting portion is sealed in the outer casing.

In some embodiments, the second supporting portion further includes a ground engaging portion to engage with the elastic claw ground terminal and be sealed in the outer casing.

Hence, the foregoing structure of the connector assembly can effectively improve the connection stability of the wire end connector and the board end connector, the elastic claws can connect the ground circuit to improve the signal transmission stability of the connector assembly, and the inner film, the outer casing and the intermediate casing can effectively improve the positioning accuracy and the waterproof ability of the connector assembly, thereby improving the transmission rate and transmission quality of the connector assembly.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
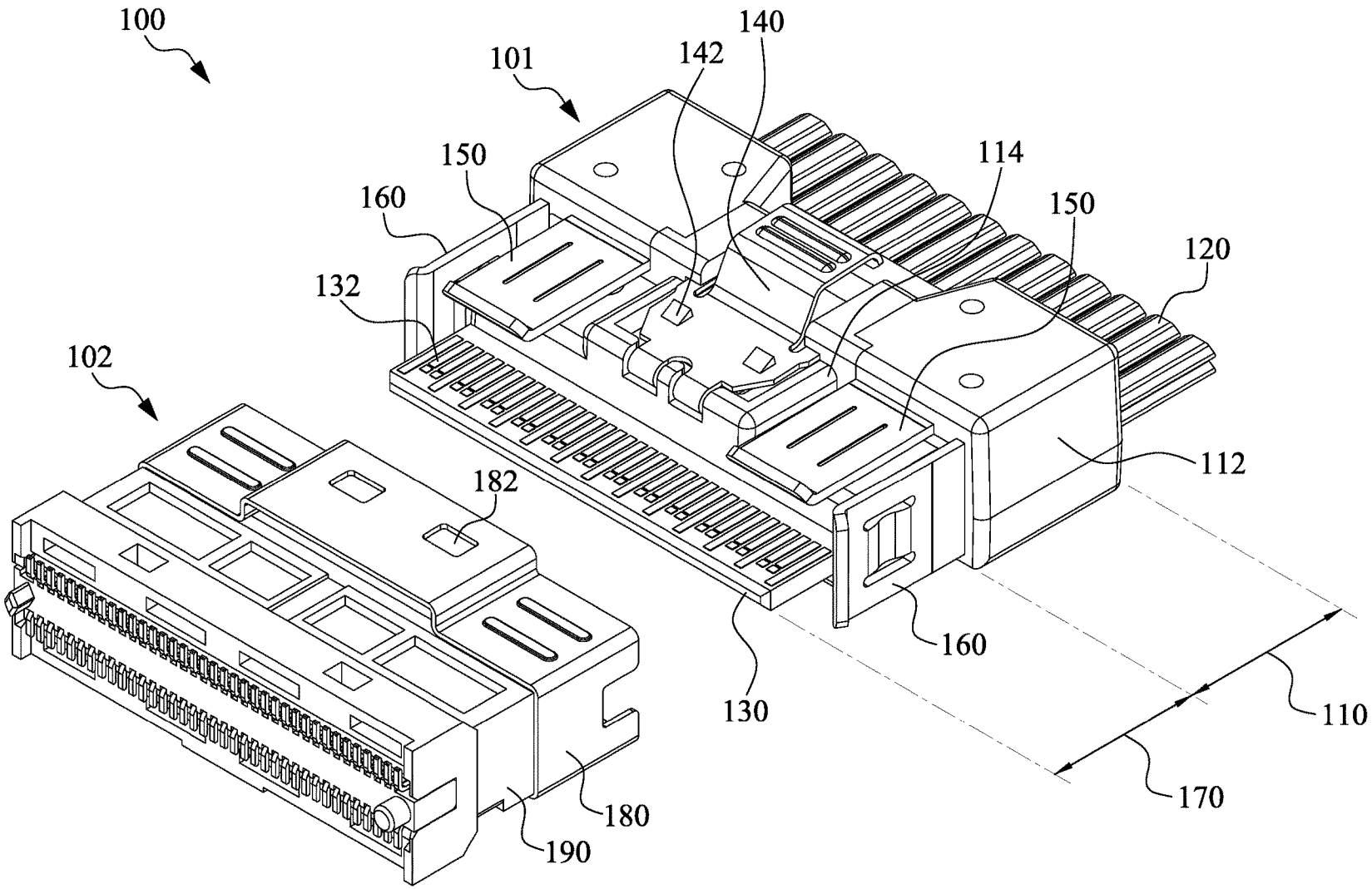
FIG. 1 illustrates a schematic perspective diagram showing a connector assembly according to one embodiment of the present invention.
Figure 2:
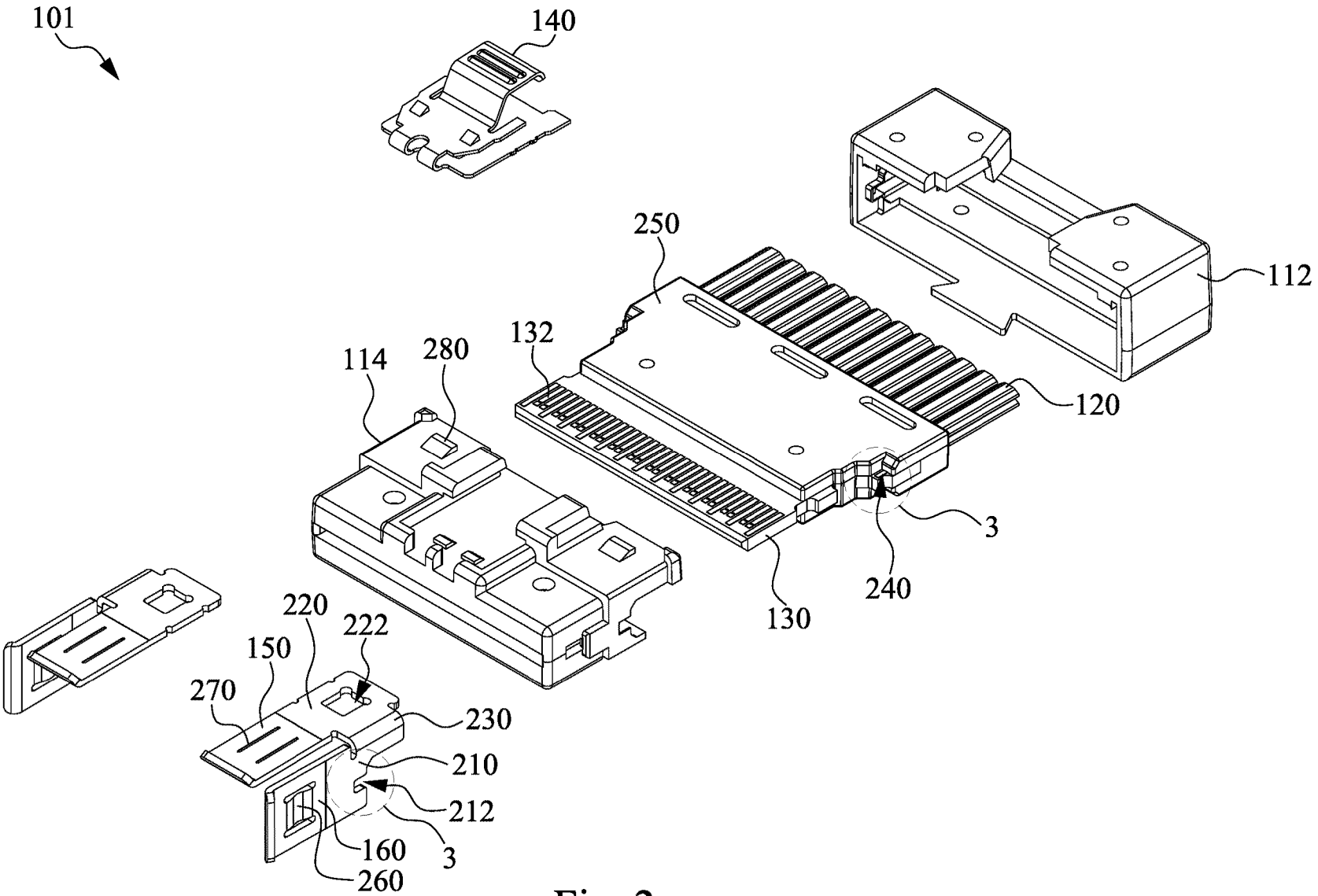
FIG. 2 illustrates an exploded diagram showing the wire end connector of the connector assembly according to one embodiment of the present invention.
Figure 3:
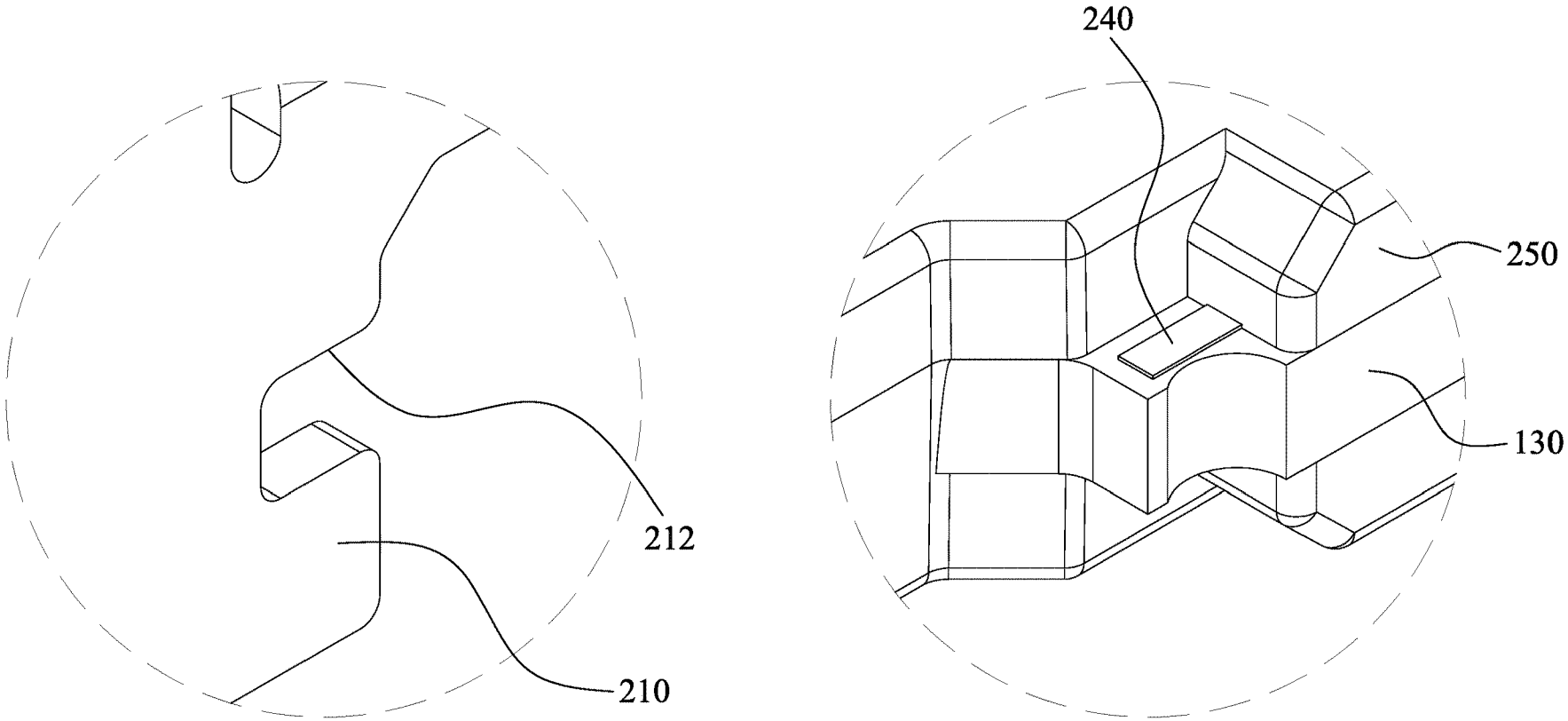
FIG. 3 illustrates a partial enlarged view of the wire end connector of the connector assembly according to one embodiment of the present invention.
Figure 4:
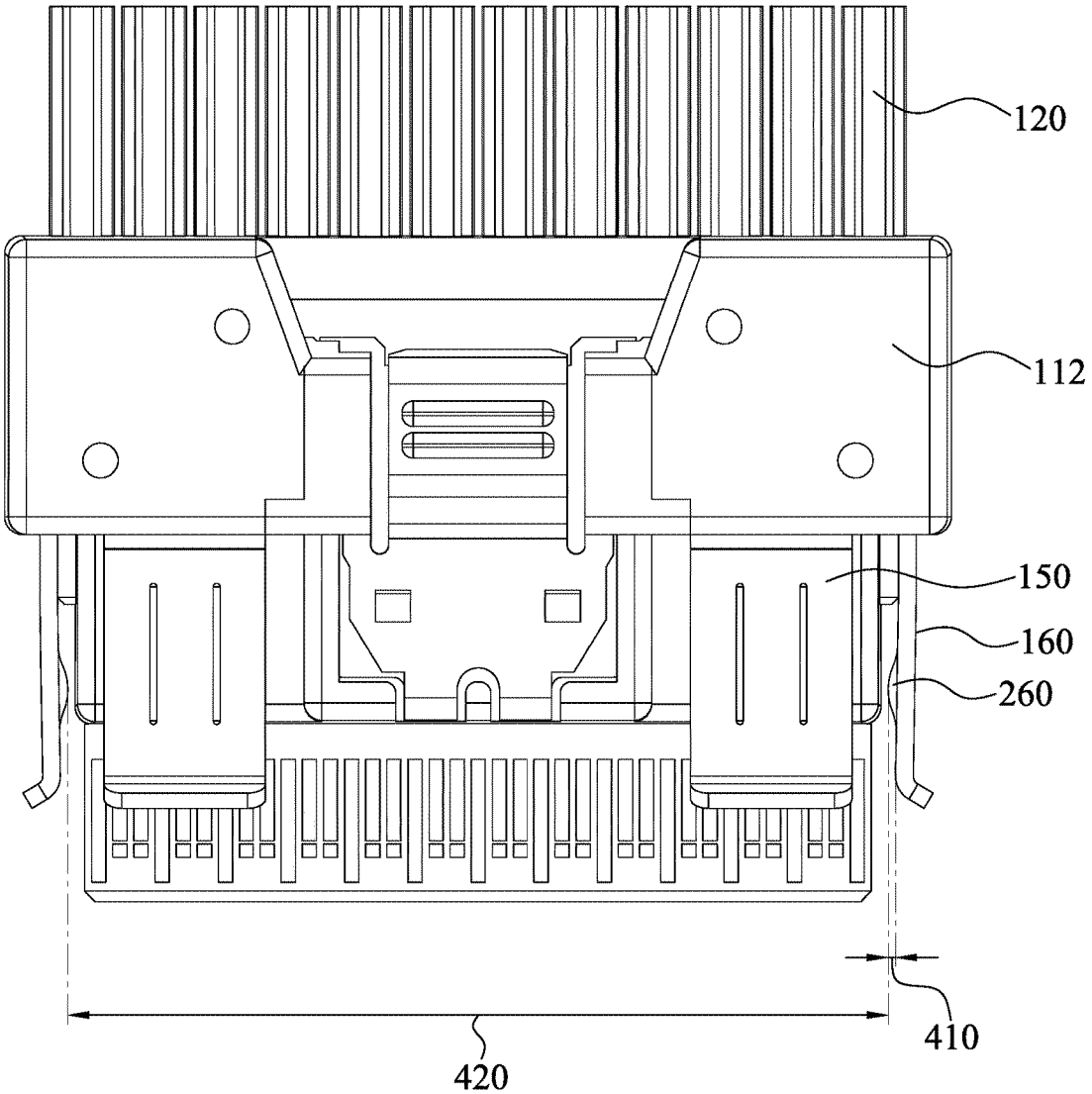
FIG. 4 illustrates a top view of the wire end connector of the connector assembly according to one embodiment of the present invention.

Refer to FIGS. 1-4. FIG. 1 illustrates a schematic perspective diagram of a connector assembly according to one embodiment of the present invention, FIG. 2 illustrates an exploded diagram of the wire end connector thereof, FIG. 3 illustrates a partial enlarged view of the wire end connector thereof to show the elastic claw ground terminal on the printed circuit board and the ground engaging portion of the elastic claw, and FIG. 4 illustrates a top view of the wire end connector thereof.

Simultaneously referring to FIGS. 1-4, a connector assembly 100 has a wire end connector 101 for electrically connecting to a board end connector 102. The wire end connector 101 includes a main body portion 110 and an insertion portion 170. The insertion portion 170 is connected to the main body portion 110 and the insertion portion 170 is configured to couple to the board end connector 102. It is worth noting that the main body portion 110 includes a plurality of elastic claws, e.g. first elastic claws 150 and second elastic claws 160, extending from the main body portion 110 to exert pressure upon the board end connector 102 when the insertion portion 170 and the board end connector 102 are coupled together so as to stably connect to the board end connector 102.

The wire end connector 101 further includes a printed circuit board 130, a cable 120, an inner film 250, an intermediate casing 114, a spring latch 140 and an outer casing 112.

The printed circuit board 130 is disposed in the main body portion 110 and the insertion portion 170. The cable 120 is soldered on the printed circuit board 130 and the inner film 250 covers soldering joints of the cable 120 and the printed circuit board 130 to improve the stability and service life of the wire end connector 101.

In some embodiments, the inner film 250 is formed by an insert molding process to cover a portion of the cable 120 and a portion of the printed circuit board 130 to protect the soldering joints of the cable 120 and the printed circuit board 130 so as to improve the service life of the wire end connector 101.

The intermediate casing 114 covers the inner film 250, and exposes a plurality of signal terminals 132 of the printed circuit board 130 and at least one elastic claw ground terminal 240. The signal terminals 132 are exposed from the insertion portion 170 and the elastic claw ground terminal 240 is sealed in the main body portion 110.

In some embodiments, the intermediate casing 114 is formed by a plastic injection process and assembled on the outside of the inner film 250. Alternatively, the intermediate casing 114 is formed by a plastic injection process and directly formed around the inner film 250. Therefore, the insertion and removal strength of the wire end connector 101 is improved.

In some embodiments, the spring latch 140 is fixed on the intermediate casing 114 to engage with the board end connector 102. The spring latch 140 further includes a hook 142, and the board end connector 102 includes a board end connector main body 190 and a metal shell 180. A hooking opening 182, corresponding to the position of the hook 142, is formed on the metal shell 180. When the wire end connector 101 is inserted into the board end connector 102, the hook 142 on the spring latch 140 can engage with the hooking opening 182 on the metal shell 180 to prevent the wire end connector 101 from being accidentally separated from the board end connector 102.

The outer casing 112 is formed at the position of the main body portion 110 and covers a portion of the intermediate casing 114, a portion of the inner film 250 and a portion of the elastic claws. In addition, at least portions of the printed circuit board 130, the inner film 250 and the intermediate casing 114 are formed in the main body portion 110, and another portions of the printed circuit board 130, the inner film 250 and the intermediate casing 114 are formed in the insertion portion 170. The spring latch 140 is formed in the insertion portion 170 and the cable 120 is formed in the main body portion 110.

In some embodiments, the outer casing 112 is formed by an outer molding process to effectively fix the intermediate casing 114, the inner film 250, the elastic claws and the cable 120 so as to improve the waterproof ability of the wire end connector 101 and further improve the product quality of the connector assembly 100.

The elastic claw ground terminal 240 is exposed from the inner film 250 and is sealed in the outer casing 112, and the elastic claw ground terminal 240 is electrically connected to at least one of the elastic claws to provide the ground function for the connector assembly 100. When the wire end connector 101 is inserted into the board end connector 102, the elastic claws can press on the metal shell 180 of the board end connector 102 and further electrically connect to the metal shell 180 of the board end connector 102. In some embodiments, the elastic claw ground terminal 240 is formed in the main body portion 110.

In some embodiments, the elastic claws include a plurality of first elastic claws 150 and a plurality of second elastic claws 160 perpendicular to the first elastic claws 150. The tailing ends of the first elastic claws 150 and the second elastic claws 160 are embedded in the outer casing 112 to provide independent clamping forces on the metal shell 180 of the board end connector 102 so that the clamping force between the wire end connector 101 and the board end connector 102 is therefore increased to prevent the loosening problem between the wire end connector 101 and the board end connector 102 and improve the transmission quality and capability. In addition, the first elastic claw 150 and the second elastic claw 160 can improve the accuracy of inserting the wire end connector 101 into the board end connector 102 and prevent the skewing problem therebetween so as to increase the service life of the connector assembly 100.

In some embodiments, a plurality of first elastic claws 150 are parallel to the surface of the printed circuit board 130 to press on a metal shell 180 of the board end connector 102. The second elastic claws 160 are perpendicular to the surface of the printed circuit board 130 so as to clamp two sides of the metal shell 180 of the board end connector 102.

In some embodiments, referring to FIG. 2, the first elastic claw 150 further includes a pressure bumps 270 protruding downward and parallel to a plug and unplug direction between the wire end connector 101 and the board end connector 102 of the wire end connector 101 to increase the pressure force of the first elastic claws 150 acting on the metal shell 180 and reduce the resistance force while the wire end connector 101 plugging into the board end connector 102 so as to improve the connection quality of the connector assembly 100.

In some embodiments, referring to FIG. 4, the second elastic claw 160 includes a pressurized curved surface 260 protruding from a surface of the second elastic claw 160 about 0.01 mm to 1 mm. In addition, with the second elastic claws 160 formed on both sides of the wire end connector 101, the distance between the pressurized curved surfaces 260 is smaller than the width of the metal shell 180 of the board end connector 102. In some embodiments, when the width of the metal shell 180 is about 23.5 mm, the distance 420 of the second elastic claw 160 is about 23.48 mm to 21.5 mm.

In some embodiments, the first elastic claw 150 further include a first supporting portion 220, the second elastic claw 160 includes a second supporting portion 210, a connecting portion 230 is connected to the first supporting portion 220 and the second supporting portion 210, and the connecting portion 230 is sealed in the outer casing 112.

In some embodiments, the second supporting portion 210 further includes a ground engaging portion 212 to engage with the elastic claw ground terminal 240 and be sealed in the outer casing 112 to improve the waterproof ability and further improve the product reliability of the connector assembly 100.

In some embodiments, the first supporting portion 220 further includes a fixing hole 222 to engage with a protruding portion 280 of the intermediate casing 114 so as to avoid the separation between the elastic claws and the wire end connector 101.

Accordingly, the foregoing structure of the connector assembly can effectively improve the connection stability of the wire end connector and the board end connector of the connector assembly, the elastic claws can connect the ground circuit to improve the signal transmission stability of the connector assembly, and the inner film, the outer casing and the intermediate casing can effectively improve the positioning accuracy and the waterproof ability of the connector assembly, thereby improving the transmission rate and transmission quality of the entire connector assembly, and further improving the transmission rate and transmission quality of the high speed connector assembly.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A connector assembly having a wire end connector for electrically connecting to a board end connector, wherein the wire end connector comprises:

a main body portion;

an insertion portion connecting to the main body portion, wherein the insertion portion is configured to couple to the board end connector, and the main body portion comprises a plurality of elastic claws extending outwardly from the main body portion to exert pressure upon the board end connector when the insertion portion and the board end connector are coupled together so as to stably connect the board end connector;

a printed circuit board disposed in the main body portion and the insertion portion;

a cable soldered on the printed circuit board;

an inner piece covering soldering joints of the cable and the printed circuit board;

an intermediate casing covering the inner piece and exposing a plurality of signal terminals of the printed circuit board;

a spring latch fixed on the intermediate casing; and an outer casing covering a portion of the intermediate casing, a portion of the inner piece and a portion of the elastic claws, p1 wherein the printed circuit board further comprises at least one elastic claw ground terminal exposing from the inner piece and sealed in the outer casing, and the at least one elastic claw ground terminal is electrically connected to at least one of the elastic claws.

2. The connector assembly of claim 1, wherein the elastic claws comprises:

a plurality of first elastic claws parallel to a surface of the printed circuit board to press on a metal shell of the board end connector.

3. The connector assembly of claim 2, wherein the elastic claws further comprise:

a plurality of second elastic claws perpendicular to the surface of the printed circuit board so as to clamp two sides of the metal shell of the board end connector.

4. The connector assembly of claim 3, wherein at least one of the first elastic claws further comprises a pressure bump parallel to a plug and unplug direction between the wire end connector and the board end connector, and at least one of the second elastic claws comprises a pressurized curved surface protruding from a surface of the at least one of the second elastic claws about 0.01 mm to 1 mm.

5. The connector assembly of claim 3, wherein at least one of the first elastic claws further comprises a first supporting portion, at least one of the second elastic claws further comprises a second supporting portion, a connecting portion is connected to the first supporting portion and the second supporting portion, and the connecting portion is sealed in the outer casing.

6. The connector assembly of claim 5, wherein the second supporting portion further comprises a ground engaging portion to engage with the elastic claw ground terminal and be sealed in the outer casing.

7. A wire end connector, comprising:

a main body portion;

an insertion portion connecting to the main body portion, wherein the main body portion comprises a plurality of elastic claws extending outwardly from the main body portion; and a printed circuit board disposed in the main body portion and the insertion portion, wherein the printed circuit board comprises at least one elastic claw ground terminal electrically connected to at least one of the elastic claws.

8. The wire end connector of claim 7, wherein the plurality of the elastic claws comprises:

a first elastic claw parallel to a surface of the printed circuit board; and a second elastic claw perpendicular to the surface of the printed circuit board.

9. The wire end connector of claim 8, wherein the first elastic claw further comprises a pressure bump parallel to a plug and unplug direction, and the second elastic claw comprises a pressurized curved surface protruding from a surface of the second elastic claw about 0.01 mm to 1 mm.

10. The wire end connector of claim 8, wherein the first elastic claw further comprises a first supporting portion, the second elastic claw further comprises a second supporting portion, and a connecting portion is connected to the first supporting portion and the second supporting portion.

11. The wire end connector of claim 10, wherein the second supporting portion further comprises a ground engaging portion to engage with the elastic claw ground terminal.

12. A connector, comprising:

a main body portion;

an insertion portion connecting to the main body portion, wherein the main body portion comprises a plurality of elastic claws extending outwardly from the main body portion;

a printed circuit board disposed in the main body portion and the insertion portion;

a cable soldered on the printed circuit board; and an inner piece covering soldering joints of the cable and the printed circuit board, wherein the inner piece and each of the plurality of elastic claws are two independent components respectively, wherein the printed circuit board further comprises at least one elastic claw ground terminal exposing from the inner piece, and the at least one elastic claw ground terminal is electrically connected to at least one of the elastic claws.

13. The connector of claim 12, wherein the plurality of the elastic claws comprises:

a first elastic claw parallel to a surface of the printed circuit board; and a second elastic claw perpendicular to the surface of the printed circuit board.

14. The connector of claim 13, wherein the first elastic claw further comprises a pressure bump parallel to a plug and unplug direction, and the second elastic claw comprises a pressurized curved surface protruding from a surface of the second elastic claw about 0.01 mm to 1 mm.

15. The connector of claim 13, wherein the first elastic claw further comprises a first supporting portion, the second elastic claw further comprises a second supporting portion, and a connecting portion is connected to the first supporting portion and the second supporting portion.

16. The connector of claim 15, wherein the second supporting portion further comprises a ground engaging portion to engage with the elastic claw ground terminal.

* * * * *